US006643901B1

(12) United States Patent
Parks et al.

(10) Patent No.: US 6,643,901 B1
(45) Date of Patent: Nov. 11, 2003

(54) LOOM BEAMS

(75) Inventors: Steven J. Parks, Lexington, NC (US); William B. Rice, Clemmons, NC (US)

(73) Assignee: PPG Industries Ohio, Inc., Cleveland, OH (US)

( * ) Notice: Subject to any disclaimer, the term of this patent is extended or adjusted under 35 U.S.C. 154(b) by 321 days.

(21) Appl. No.: 09/704,400

(22) Filed: Nov. 1, 2000

(51) Int. Cl.[7] ..... D02H 5/02
(52) U.S. Cl. ..... 28/172.1; 28/178; 28/190
(58) Field of Search ..... 28/172.1, 178, 28/179, 180, 181, 182, 183, 190, 191; 427/439, 442, 443; 139/35, 420 R, 426 R, 420 C; 206/389, 391, 392, 394, 227; 8/115.6, 151.2, 155, 155.2

(56) References Cited

U.S. PATENT DOCUMENTS 3,391,052 A * 7/1968 Marzocchi ..... 28/178
3,670,490 A * 6/1972 Kneafsey ..... 57/309
3,779,207 A * 12/1973 Benson et al. ..... 28/28
4,470,252 A * 9/1984 Brodmann ..... 28/178
4,756,714 A * 7/1988 Hendrix et al. ..... 8/115.6
4,774,135 A * 9/1988 Bryant ..... 28/182
4,858,287 A * 8/1989 Maurer et al. ..... 28/172.1
5,157,818 A * 10/1992 Voswinckel ..... 28/180
5,896,634 A * 4/1999 Brodowski et al. ..... 28/178
6,263,937 B1 * 7/2001 Barnes ..... 156/426
6,283,164 B1 * 9/2001 Parks ..... 139/114
2002/0051882 A1 * 5/2002 Lawton et al. ..... 428/378
2002/0055313 A1 * 5/2002 Velpari et al. ..... 442/180
2002/0058140 A1 * 5/2002 Dana et al. ..... 428/375
2002/0058449 A1 * 5/2002 Velpari et al. ..... 442/59

OTHER PUBLICATIONS

"The Manufacturing Technology of Continuous Glass Fibres" by K. Loewenstein, 3rd Ed. 1993, pp. 172–175.
"The Manufacturing Technology of Continuous Glass Fibres" by K. Loewenstein, 3rd Ed. 1993, pp. 237–244.
"The Manufacturing Technology of Continuous Glass Fibres" by K. Loewenstein, 3rd Ed. 1993, pp. 325–331.
U.S. Ser. No. 09/620,526 entitled "Impregnating Glass Fiber Strands and Products Including the Same", filed Jul. 20, 2000, assigned to PPG Industries Ohio, Inc.

* cited by examiner

*Primary Examiner*—Amy B. Vanatta
(74) *Attorney, Agent, or Firm*—Andrew C. Siminerio

(57) ABSTRACT

The present invention provides a method of forming a loom beam comprising: (A) unwinding at least one warp yarn from at least one section beam comprising a plurality of warp yarns, wherein the at least one warp yarn comprises at least one fiber comprising a resin compatible coating on at least a portion of a surface thereof; (B) applying heat to the at least one fiber; and (C) winding the at least one warp yarn with the at least one fiber onto a loom beam, wherein the at least one fiber on the loom beam is essentially free of slashing size. In one nonlimiting embodiment of the invention, positioning comprises positioning a plurality of section beams, each comprising a plurality of warp yarns, and at least one warp yarn of each section beam comprises at least one glass fiber comprising a resin compatible coating on at least a portion of a surface thereof.

37 Claims, 1 Drawing Sheet

LOOM BEAMS

BACKGROUND OF THE INVENTION

1. Field of the Invention

The present invention generally relates to loom beams and methods of forming loom beams for use in glass fiber weaving operations. More particularly, the present invention relates to loom beams and methods of forming loom beams with resin compatible glass fiber yarns that are essentially free of slashing size using conventional slashing equipment.

2. Technical Considerations

In conventional glass fiber weaving operations, a glass fabric is woven by interweaving weft yarns (often referred to as "fill yarns") into a plurality of warp yarns. Generally, this is accomplished by positioning the warp yarns in a generally parallel, planar array on a loom, and thereafter weaving the weft yarns into the warp yarns by passing the weft yarns over and under the warp yarns in a predetermined repetitive pattern. The pattern used will depend upon the desired fabric style.

Warp yarns are typically formed by attenuating a plurality of molten glass streams from a bushing or spinner. Thereafter, a coating (or primary size) is applied to the individual glass fibers and the fibers are gathered together to form a strand. The strands are subsequently processed into yarns by transferring the strands to a bobbin via a twist frame. During this transfer, the strands can be given a twist to aid in holding the bundle of fibers together. These twisted strands are then wound about the bobbin and the bobbins are used in the weaving processes.

Positioning of the warp yarns on the loom is typically done by way of a loom beam. A loom beam comprises a specified number of warp yarns (also referred to as "ends") wound in an essentially parallel arrangement (also referred to as "warp sheet") about a cylindrical core. Loom beam preparation typically requires combining multiple yarn packages, each package comprising a fraction of the number of ends required for the loom beam into a single package or loom beam. For example and although not limiting herein, a 50 inch (127 cm) wide, 7628 style fabric which utilizes a G75 yarn input typically require 2204 ends. However, conventional equipment for forming a loom beam does not allow for all of these ends to be transferred from bobbins to a single beam in one operation. Therefore, multiple beams comprising a fraction of the number of required ends, typically referred to as "section beams", are produced and thereafter combined to form the loom beam. In a manner similar to a loom beam, a section beam typically includes a cylindrical core comprising a plurality of essentially parallel warp yarns wound thereabout. While it will be recognized by one skilled in the art that the section beam can comprise any number of warp yarns required to form the final loom beam, generally the number of ends contained on a section beam is limited by the capacity of the warping creel. For a 7628 style fabric, four section beams of 551 ends each of G75 are typically provided and when combined offer the required 2204 ends for the warp sheet, as discussed above.

As previously discussed, a primary sizing composition is applied to the glass fibers, typically immediately after forming. Traditionally, the filaments forming the continuous glass fiber strands used in weaving fabric are treated with an aqueous starch-oil sizing, which typically includes partially or fully dextrinized starch or amylose, hydrogenated vegetable oil, a cationic wefting agent, emulsifying agent and water, as is well known to those skilled in the art. For more information concerning such sizing compositions, see K. Loewenstein, *The Manufacturing Technology of Continuous Glass Fibres*, (3d Ed. 1993) at pages 237–244 (3d Ed. 1993), which is specifically incorporated by reference herein. While such sizings are generally robust enough to provide protection to the fibers during fiber forming and loom beam manufacturing processes, they normally are unable to protect the glass fibers, and in particular the warp yarn fibers, from abrasion and wear during high speed weaving. As a result, it is conventional practice in the textile weaving industry to pass the warp yarn through a slasher, which applies a slashing size to the warp yarns during the manufacture of the loom beam to provide the additional protection required, in a manner to be discussed later in more detail. More particularly, the slashing operation provides the vehicle to add additional film forming chemistry to the fibers forming the warp yarn sheet. Typically, the slashing size includes either fully or partially hydrolyzed polyvinyl alcohol (PVA) materials and is a mixture in the 6–8% solids range with a viscosity of 15 to 20 centipoise (CPS). The slashing size is typically applied by submerging the warp yarn sheet in a vessel containing the slashing size via a series of submersion rollers and then passing it through a squeeze roll system, which typically exerts 15 to 20 pounds per square inch of squeezing pressure on the coated yarn in addition to the dead weight of the squeeze roller (the squeeze pressure can vary due to yarn diameter), to remove the excess slashing size. The slashing size can be applied at an elevated temperature, e.g. in the range of 130 to 150° F. (54 to 66° C.) or at room temperature, depending upon the recommendations of the PVA producer. After squeezing the excess size from the yarn sheet, the slashing sized sheet is dried in any convenient manner known in the art, such as but not limited to passing the sheet over heated rollers and/or through a hot air drying oven. In a slasher incorporating heated rollers, or cans, the surface temperature of the cans is typically in the range of 240 to 280° F. (116 to 138° C.). The actual temperature profile of the drying cans depends in part on the can arrangement, number of cans, and yarn speed. In a hot air drying oven, the air temperature within the oven typically ranges from 275 to 300° F. (135 to 149° C.). After drying, the warp yarn sheet passes through a series of split rods to separate the warp sheets and through a hook reed assembly and comb to combine the warp sheets and assure that no ends are adhered to each other. The yarn sheet is then wound onto the loom beam.

Both the primary starch-oil coating and slashing size are not compatible with polymeric resin matrix materials used to impregnate woven fabric incorporating the coated yarns. As a result, these coatings must be removed from the fabric, e.g. by heating cleaning and/or scrubbing, prior to incorporation of a fabric woven from these yarns into the matrix material. For example, a typical one-step heat cleaning process can entail heating the fabric at 600 to 800° F. (316 to 427° C.) for 70–80 hours to remove the starch-oil primary size and slashing size. In an alternative two-step operation, the fabric is unrolled through an oven where it is exposed to a flame that burns off a portion of the sizes, and then heated 600 to 800° F. (316 to 427° C.) for 50 to 60 hours. The first step of this two-step operation is sometimes referred to as caramelizing and is typically used to heat clean fabrics woven from coarse yarns, i.e. 7628 style fabric.

When a primary size that is compatible with the resin matrix material is applied to the individual glass fibers during forming, it has been found that the application of additional slashing size to protect the glass fibers is unnecessary. As a result, the need for additional fiber protection through the application of a slashing size is eliminated. However, it has been observed that when such warp yarns having a resin compatible coating are simply wound onto a loom beam from multiple section beams, for example by passing the warp yarn through a slasher without the addition of slashing size, heating and drying (sometimes referred to as "dry slashing") to form a loom beam, the number of loom beam defects, such as end breaks due to rolled and twisted ends, is excessive. Rolled ends, which is a condition wherein adjacent glass strands roll on top of each other and are twisted together, are particularly troublesome as they can lead to end breaks during weaving, which in turn are associated with fabric quality issues such as ends out, fuzzy ends, chaffed ends, and undesirable yarn splices.

Nevertheless, the capability to make loom beams with warp yarns having a resin compatible coating on a slasher without using slashing size is important since the main method of forming loom beams in the textile weaving industry is by use of a slasher and most weaving operations already have this type of equipment. As a result, it would be advantageous to provide a process whereby a loom beam can be made with yarn having a resin compatible coating using a slasher, but without the need for slashing size.

SUMMARY OF THE INVENTION

The present invention provides a method of forming a loom beam comprising: (A) unwinding at least one warp yarn from at least one section beam comprising a plurality of warp yarns, wherein the at least one warp yarn comprises at least one fiber comprising a resin compatible coating on at least a portion of a surface thereof; (B) applying heat to the at least one fiber; and (C) winding the at least one warp yarn with the at least one fiber onto a loom beam, wherein the at least one fiber on the loom beam is essentially free of slashing size. In one nonlimiting embodiment of the invention, positioning comprises positioning a plurality of section beams, each comprising a plurality of warp yarns, and at least one warp yarn of each section beam comprises at least one glass fiber comprising a resin compatible coating on at least a portion of a surface thereof.

The present invention also provides a method of forming a loom beam comprising: (A) unwinding at least one warp yarn from at least one section beam comprising a plurality of warp yarns, wherein the at least one warp yarn comprises a resin compatible coating on at least a portion of a surface thereof; (B) applying heat to the at least one warp yarn; and (C) winding the at least one warp yarn onto a loom beam, wherein the at least one warp yarn on the loom beam is essentially free of slashing size.

The present invention further provides a method of forming a loom beam comprising: (A) positioning at least two section beams at a slasher, each section beam comprising a plurality of warp yarns, wherein at least one warp yarn of each section beam comprises at least one glass fiber comprising a resin compatible coating on at least a portion of a surface thereof; (B) passing the at least one warp yarns through the slasher; (C) applying heat to the at least one warp yarns while passing the at least one warp yarns through at a portion of the slasher; and (D) combining the plurality of warp yarns from the section beams to form a loom beam, wherein the at least one warp yarns on the loom beam are essentially free of slashing size.

The present invention also provides a loom beam comprising: (A) a center roll; and (B) a plurality of warp yarns wound around the center roll, wherein at least one of the warp yarns comprises at least one fiber comprising a resin compatible coating on at least a portion of a surface thereof, and the at least one fiber is essentially free of slashing size. In one nonlimiting embodiment of the invention, the plurality of warp yarns each comprise a plurality of glass fibers comprising a resin compatible coating on at least a portion of a surface thereof, and the plurality of glass fibers are essentially free of slashing size.

The present invention further provides a loom beam comprising: (A) a center roll; and (B) a plurality of warp yarns wound around the center roll, wherein at least one of the warp yarns comprises a resin compatible coating on at least a portion of a surface thereof and is essentially free of slashing size.

DETAILED DESCRIPTION OF THE INVENTION

Figure 1:
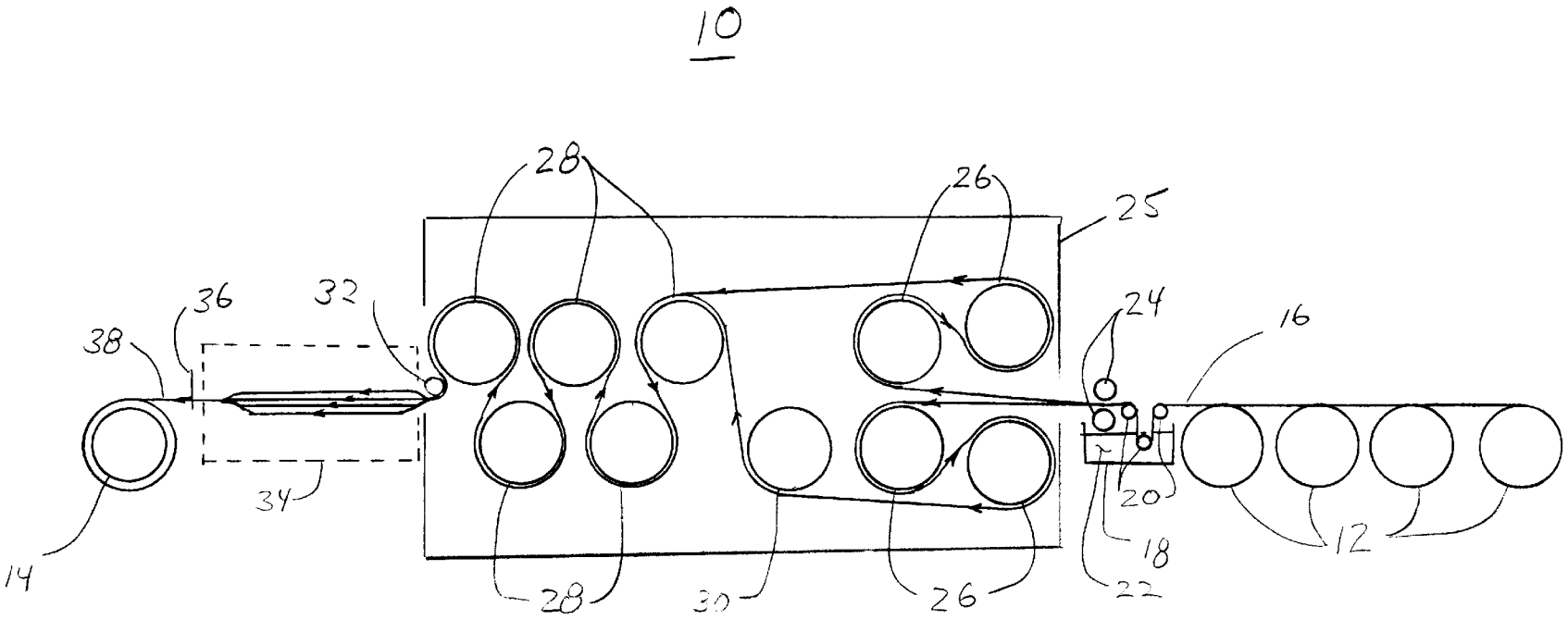
FIG. 1 is a schematic of a typical nonlimiting slasher.

The present invention is particularly advantageous in providing methods of forming high quality loom beams from resin compatible warp yarns without the use of a slashing size.

Although not meant to be limiting herein, the present invention will be described in terms of glass fiber weaving operations. However, it will be recognized by one skilled in the art that the methods and apparatus of the present invention can be used with other types of fibers well known in the art.

For the purposes of this specification, other than in the operating examples, or where otherwise indicated, all numbers expressing quantities of ingredients, processing conditions, and so forth used in the specification and claims are to be understood as being modified in all instances by the term "about". Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements.

As used herein, the term "slasher" means a device conventionally used for simultaneously coating warp yarns from two or more section beams with a slashing size, drying the slashing coated yarn and combining the warp yarns onto a single package to form a loom beam. As used herein the term "slashing size" means a non-resin compatible coating which is applied to a warp yarn after the formation of the warp yarn to form a film or coating on at least a portion of the yarn fibers that protects the yarn during weaving and is removed from the woven fabric prior to combining the fabric with a resin matrix material. Although not limiting herein, slashing sizes are typically applied over a primary size that was coated on the fibers of the yarn during formation. The term "slashing" refers to the process of passing the warp yarns through the slasher to form a loom beam. As used herein the term "fiber" means an individual filament, and the term "strand" means a plurality of fibers. The bundles of fibers can also be referred to as "yarn". In one nonlimiting embodiment of the present invention, the fibers have an average nominal fiber diameter ranging from 3 to 35 micrometers. In another nonlimiting embodiment, the average nominal fiber diameter of the present invention is 5 micrometers and greater. For "fine yarn" applications, the average nominal fiber diameter generally ranges from 5 to 7 micrometers. Methods of gathering fibers together to form strands are well known in the art. For more information see Loewenstein at pages 172–175, which are hereby incorporated by reference. Although not required, if desired, at least a portion of the glass fiber strands can be twisted. In one nonlimiting embodiment of the invention, the strand is twisted 0.7 to 1 turn per inch. In another nonlimiting embodiment of the invention, the strand is twisted 0.7–0.8 turns per inch. For more information on the formation of yarns, see Loewenstein at pages 325–331, which are hereby incorporated by reference. Table A lists the diameters and number of fibers in a yarn for several non-limiting glass fiber yarn products.

TABLE A

| Yarn type | Fiber Diameter (centimeters) | Number of Fibers in Strand |
|---|---|---|
| G75 | $9 \times 10^{-4}$ | 400 |
| G150 | $9 \times 10^{-4}$ | 200 |
| E225 | $7 \times 10^{-4}$ | 200 |
| D450 | $5.72 \times 10^{-4}$ | 200 |

FIG. 1 illustrates one non-limiting slasher configuration. More particularly, slasher 10 includes a frame (not shown) to position and support a plurality of section beams 12 which will be combined to form a loom beam 14. Typically, 2 to 8 section beams are combined to form the loom beam, depending on the fabric style and the size of the section beams. The warp sheets for each section beam 12, which comprises a plurality of closely spaced generally parallel fiber strands, are combined to form a combined warp sheet 16 that is directed through a size box 18 by a set of submersion rolls 20. The size box 18 contains a slashing size 22 so that as the warp sheet 16 passes through the size box 18 it is coated with slashing size 22. The coated warp sheet then passes between a set of squeeze rolls 24 to remove the excess slashing size and then through a drier 25 to dry the slashed yarn. Although not limiting herein, the drying operation includes a yarn heating arrangement to remove the aqueous portion of the slashing size and leave a protective coating on the yarn. Non-limiting examples of suitable heating devices include heated rollers or cans, or hot air circulating ovens. In the particular non-limiting embodiment of the slasher shown in FIG. 1, the drying is performed by passing the coated yarn in a serpentine manner over a series of heated cans, and in particular a series of initial drying cans 26 and a series of finishing cans 28. In one non-limiting slasher configuration, the cans are typically hollow cylindrical rollers that are heated in any convenient manner, e.g. by circulating steam through the cans. In the particular slasher 10 configuration illustrated in FIG. 1, the initial drying cans 26 can be run at a higher temperature than the finishing cans 28 in order to initiate the drying operation and the finishing cans 28 finish the drying so that the slashing sized yarn is dry when it exits the drier 25. Although not required, if desired the warp sheet 16 can be separated as shown in FIG. 1 so that the warp sheet from 1 or more of the section beams 12 can follow a serpentine path through a first grouping of initial drying cans while the warp sheet of the remaining section beams 12 can follow a serpentine path through a second grouping of initial drying cans. The separated warp sheets can then be recombined (using idler rolls 30 as required) and passed in a serpentine manner around the finishing cans 28. The warp sheet 16 is then processed to ensure that the yarns are not twisted together prior to being wound about a center roll 31 to form the loom beam 14. More specifically, the dried warp sheet 16 passes around an idler roll 32 and through an assembly 34 that includes a plurality of split rods (not shown) to separate the combined warp sheet 16 into its original warp sheets and a hook reed assembly that combines the ends of the individual warp sheets and positions them at the desired location in the loom beam warp sheet 36. The warp sheet 36 then passes through a comb 38 to ensure that adjacent yarn ends of the warp sheet 36 are not entangled prior to being wound on the loom beam 14.

The speed of the warp sheets through the slasher 10 depends on how quickly the drier 25 can dry the slashed warp yarn. In the particular slasher configuration shown in FIG. 1, the yarn speed will depend, in part on the number and positioning of the cans and the can temperature. Typically, the speed of the warp sheets through the slasher ranges from 30 to 70 yards per minute (27 to 64 meters per minute), and more typically 45 to 60 yards per minute (41 to 55 meters per minute).

Non-limiting examples of commercial slashers which are suitable for use in the present invention are manufactured by Ira L. Griffen Sons, Inc. of Charlotte, N.C., West Point Foundry and Machine of West Point, Ga., and Sucker Mueller of Moenchengladbach, Germany.

One nonlimiting embodiment of the present invention comprises a method of forming a loom beam without the use of a slashing size, wherein at least one of the warp yarns of at least one of the section beams comprises at least one glass fiber having a resin compatible coating applied to at least a portion of a surface thereof. In one nonlimiting embodiment of the invention, the resin compatible coating is applied during fiber forming. As used herein the term "resin compatible" means the coating composition applied to the glass fibers is compatible with the polymeric matrix material into which the glass fibers will be incorporated such that the coating composition (or selected coating components) achieves at least one of the following properties: does not require removal prior to incorporation into the matrix material (such as by heat cleaning and/or scrubbing), facilitates good penetration of the matrix material through the individual bundles of fibers in a mat or fabric incorporating the yarn and good penetration of the matrix material through the mat or fabric during conventional processing, and results in final products having desired physical properties and hydrolytic stability (i.e. resistance to migration of water along the fiber/polymeric matrix material interface). In one nonlimiting embodiment of the invention, all of the warp yarns used to make the loom beam comprise a resin compatible coating positioned upon at least a portion of the surfaces thereof. In another nonlimiting embodiment of the invention, all of the warp yarns used to make the loom beam comprise a plurality of fibers comprising a resin compatible coating positioned upon at least a portion of the surfaces thereof.

Without limiting the present invention, one embodiment of the resin compatible coating composition comprises one or more particles that when applied to the fibers adhere to the fibers and provide one or more interstitial spaces between adjacent glass fibers. One nonlimiting embodiment of the invention comprises a plurality of such particles. Nonlimiting examples of particles useful in the present invention include hexagonal boron nitride and hollow styrene acrylic polymeric particles.

In addition to the particles, a non-limiting embodiment of the resin compatible coating composition comprises one or more film-forming materials, such as organic, inorganic and polymeric materials. Non-limiting examples of film-forming materials include vinyl polymer, such as, but are not limited to, polyvinyl pyrrolidones, polyesters, polyamides, polyurethanes, and combinations thereof.

In addition to or in lieu of the film forming materials discussed above, a non-limiting embodiment of the resin compatible coating compositions can include one or more glass fiber coupling agents such as organo-silane coupling agents, transition metal coupling agents, phosphonate coupling agents, aluminum coupling agents, amino-containing Werner coupling agents and mixtures thereof.

A non-limiting embodiment of the resin compatible coating compositions can further comprise one or more softening agents or surfactants. Non-limiting examples of softening agents include amine salts of fatty acids, alkyl imidazoline derivatives, acid solubilized fatty acid amides, condensates of a fatty acid and polyethylene imine and amide substituted polyethylene imines.

A non-limiting embodiment of the resin compatible coating compositions can further include one or more lubricious materials that are chemically different from the polymeric materials and softening agents discussed above to impart desirable processing characteristics to the fiber strands during weaving. Non-limiting examples of such fatty acid esters useful in the present invention include cetyl palmitate, cetyl myristate, cetyl laurate, octadecyl laurate, octadecyl myristate, octadecyl palmitate and octadecyl stearate. Other useful fatty acid ester, lubricious materials include trimethylolpropane tripelargonate, natural spermaceti and triglyceride oils, such as but not limited to soybean oil, linseed oil, epoxidized soybean oil, and epoxidized linseed oil. The lubricious materials can also include non-polar petroleum waxes and water-soluble polymeric materials, such as but not limited to polyalkylene polyols and polyoxyalkylene polyols.

A non-limiting embodiment of the resin compatible coating compositions can additionally include a resin reactive diluent to further improve lubrication of the coated fiber strands. As used herein, "resin reactive diluent" means that the diluent includes functional groups that are capable of chemically reacting with the same resin with which the coating composition is compatible. The diluent can be any lubricant with one or more functional groups that react with a resin system. In one nonlimiting embodiment, the lubricant includes functional groups that react with an epoxy resin system. Non-limiting examples of suitable lubricants include lubricants with amine groups (e.g. a modified polyethylene amine), alcohol groups (e.g. polyethylene glycol), anhydride groups, acid groups (e.g. fatty acids)or epoxy groups (e.g. epoxidized soybean oil and epoxidized linseed oil).

A non-limiting embodiment of the resin compatible coating compositions can additionally include one or more emulsifying agents for emulsifying or dispersing components of the coating compositions, such as the particles and/or lubricious materials. Non-limiting examples of suitable emulsifying agents or surfactants include polyoxyalkylene block copolymers, ethoxylated alkyl phenols, polyoxyethylene octylphenyl glycol ethers, ethylene oxide derivatives of sorbitol esters, polyoxyethylated vegetable oils, ethoxylated alkylphenols, and nonylphenol surfactants.

Other additives can be included in non-limiting embodiments of the resin compatible coating compositions, such as cross-linking materials, plasticizers, silicones, fungicides, bactericides and anti-foaming materials. Organic and/or inorganic acids or bases in an amount sufficient to provide the coating composition with a pH of 2 to 10 can also be included in the resin compatible coating composition.

Non-limiting examples of resin compatible coatings are shown in Table B, wherein the tabled values are the weight percent of the specified component of the total coating composition on a total solids basis.

TABLE B

| | Examples | | | | | | | |
|---|---|---|---|---|---|---|---|---|
| COMPONENT | A | B | C | D | E | F | G | H |
| PVP K-30[1] | 13.7 | 13.4 | 13.5 | 13.4 | | | 15.3 | 14.2 |
| STEPANTEX 653[2] | 27.9 | 27.3 | | | | | 13.6 | 12.6 |
| A-187[3] | 1.7 | 1.6 | 1.9 | 1.9 | 2.8 | 2.3 | 1.9 | 1.7 |
| A-174[4] | 3.4 | 3.3 | 3.8 | 3.8 | 4.8 | 4.8 | 3.8 | 3.5 |
| EMERY 6717[5] | 2.3 | 2.2 | 1.9 | 1.9 | | | 2.5 | 2.4 |
| MACOL OP-10[6] | 1.5 | 1.5 | | | | | 1.7 | 1.6 |
| TMAZ-81[7] | 3.0 | 3.0 | | | | | 3.4 | 3.1 |
| MAZU DF-136[8] | 0.2 | 0.2 | | | | | 0.3 | 0.2 |
| ROPAQUE OP-96[9] | 39.3 | 38.6 | | | | | 43.9 | 40.7 |
| RELEASECOAT-CONC 25[10] | 4.2 | 6.3 | 6.4 | 3.8 | | | | 4.5 |
| POLARTHERM PT 160[11] | 2.7 | 2.6 | 2.6 | 5.9 | | | | 2.8 |
| SAG 10[12] | | | 0.2 | 0.2 | | | | |
| RD-847A[13] | | | 23.2 | 23.0 | | | | |
| DESMOPHEN 2000[14] | | | 31.2 | 31.0 | 44.4 | 44.1 | | |
| PLURONIC F-108[15] | | | 8.5 | 8.4 | | 10.9 | | |
| ALKAMULS EL-719[16] | | | 3.4 | 2.5 | | | | |
| ICONOL NP-6[17] | | | 3.4 | 4.2 | | 3.6 | | |
| POLYOX WSR 301[18] | | | | | 0.6 | 0.6 | | |
| DYNAKOLL Si 100[19] | | | | | 29.1 | 28.9 | | |
| SERMUL EN 668[20] | | | | | 2.9 | | | |
| SYNPERONIC F-108[21] | | | | | 10.9 | | | |
| EUREDUR 140[22] | | | | | 4.9 | | | |
| VERSAMID 140[23] | | | | | | 4.8 | | |
| FLEXOL EPO[24] | | | | | | | 13.6 | 12.6 |

TABLE B-continued

| COMPONENT | Examples | | | | | | | |
|---|---|---|---|---|---|---|---|---|
| | A | B | C | D | E | F | G | H |

[1]PVP K-30 polyvinyl pyrrolidone which is commercially available from ISP Chemicals of Wayne, New Jersey.
[2]STEPANTEX 653 which is commercially available from Stepan Company of Maywood, New Jersey.
[3]A-187 gamma-glycidoxypropyltrimethoxysilane which is commercially available from CK Witco Corporation of Tarrytown, New York.
[4]A-174 gamma-methacryloxypropyltrimethoxysilane which is commercially available from CK Witco Corporation of Tarrytown, New York.
[5]EMERY ® 6717 partially amidated polyethylene imine which is commercially available from Cognis Corporation of Cincinnati, Ohio.
[6]MACOL OP-10 ethoxylated alkylphenol; this material is similar to MACOL OP-10 SP except that OP-10 SP receives a post treatment to remove the catalyst; MACOL OP-10 is no longer commercially available.
[7]TMAZ-81 ethylene oxide derivative of a sorbitol ester which is commercially available from BASF Corp. of Parsippany, New Jersey.
[8]MAZU DF-136 antifoaming agent which is commercially available from BASF Corp. of Parsippany, New Jersey.
[9]ROPAQUE ® OP-96, 0.55 micron particle dispersion which is commercially available from Rohm and Haas Company of Philadelphia, Pennsylvania.
[10]ORPAC BORON NITRIDE RELEASECOAT-CONC 25 boron nitride dispersion which is commercially available from ZYP Coatings, Inc. of Oak Ridge, Tennessee.
[11]POLARTHERM ® PT 160 boron nitride powder which is commercially available from Advanced Ceramics Corporation of Lakewood, Ohio.
[12]SAG 10 antiforming material, which is commercially available from CK Witco Corporation of Greenwich, Connecticut.
[13]RD-847A polyester resin which is commercially available from Borden Chemicals of Columbus, Ohio.
[14]DESMOPHEN 2000 polyethylene adipate diol which is commercially available from Bayer Corp. of Pittsburgh, Pennsylvania.
[15]PLURONIC ™ F-108 polyoxypropylene-polyoxyethylene copolymer which is commercially available from BASF Corporation of Parsippany, New Jersey.
[16]ALKAMULS EL-719 polyoxyethylated vegetable oil which is commercially available from Rhone-Poulenc.
[17]ICONOL NP-6 alkoxylated nonyl phenol which is commercially available from BASF Corporation of Parsippany, New Jersey.
[18]POLYOX WSR 301 poly(ethylene oxide) which is commercially available from Union Carbide Corp. of Danbury, Connecticut.
[19]DYNAKOLL Si 100 rosin which is commercially available from Eka Chemicals AB, Sweden.
[20]SERMUL EN 668 ethoxylated nonylphenol which is commercially available from CON BEA, Benelux.
[21]SYNPERONIC F-108 polyoxypropylene-polyoxyethylene copolymer; it is the European counterpart to PLURONIC F-108.
[22]EUREDUR 140 is a polyamide resin, which is commercially available from Ciba Geigy, Belgium.
[23]VERSAMID 140 polyamide resin which is commercially available from Cognis Corp. of Cincinnati, Ohio.
[24]FLEXOL EPO epoxidized soybean oil commercially available from Union Carbide of Danbury, Connecticut.

Additional non-limiting examples of glass fiber yarns having a resin compatible coating are disclosed in U.S. Ser. No. 09/620,526 entitled "Impregnating Glass Fiber Strands and Products Including the Same" and filed Jul. 20, 2000, which is hereby incorporated by reference.

As discussed earlier, it has been found that when the individual glass fibers of the warp yarn includes a resin compatible primary size, e.g. of the type discussed above, the application of additional slashing size to protect the glass fibers during weaving is unnecessary. Although not limiting herein, it is believed that the resin compatible sizing forms a more robust coating on the individual fibers than conventional starch-oil sizings. However, simply dry slashing the resin compatible warp yarn to form a loom beam results in an excessive number of loom beam defects, such as end breaks due to rolled and twisted ends.

Surprisingly, it has been observed that when dry slashing of warp yarn having a resin compatible coating is combined with a heating cycle, the incidence of the undesirable loom beam defects associated with unheated dry slashing is significantly reduced or eliminated. Furthermore, it has been observed that the tendency for the yarn ends to roll and/or cling together can be substantially reduced or eliminated by exposing the yarn sheet to heat as it is processing through the slasher. Although not meant to be bound by any particular theory, it is believed that by heating the warp yarns as they pass through the slasher, the resin compatible coating on the surface of the warp yarns can reflow to form a more continuous coating having a high film strength. As used herein, the term "reflow" means that the resin compatible coating is redistributed over the fibers and yarn to increase overall coating coverage. In addition, the heating also appears to reduce any tackiness of the coating. By improving the integrity of the coating, the strength of the coated glass fibers can be increased and its resistance to abrasion during handling and weaving can be improved, resulting in reduced occurrences of end breaks. Furthermore, although not limiting herein, it has also been observed that the resin compatible warp yarns are stiffer after heating, i.e. more rod-like, which is believed to be advantageous for good weaving performance.

In one non-limiting embodiment of the present invention, after positioning the section beams 12 on the slasher 10, the warp yarns of each of the section beams are passed through the slasher, i.e. the warp yarns are continuously unwound from the section beams and pulled through the slasher. At least one of the warp yarns of at least one of the section beams comprises at least one glass fiber having a resin compatible coating applied to at least a portion of a surface thereof. In one nonlimiting embodiment of the invention, all the glass fibers of the warp yarns have a resin compatible coating applied to at least a portion of their surface. However, slashing size is not applied to the warp sheet 16. This can be accomplished in any convenient manner, e.g. by leaving the size box 18 empty or by bypassing the size box 18 and directing the warp sheets directly into the drier 25. While passing through the drier 25, the warp yarns are heated to a temperature sufficient to prevent fiber breaks due to rolled ends in any convenient manner. For example and without limiting the present invention, in a slasher that uses heated cans to heat and dry slashed warp yarn, the surface temperature of the cans for heating the warp yarn without the slashing size can range from 240 to 290° F. (116 to 143° C.). In another nonlimiting embodiment of the invention, the surface temperature of the cans for heating the warp yarn without the slashing size can range from 250 to 280° F. (121 to 138° C.). In a nonlimiting embodiment of the invention wherein the slasher uses hot air to heat and dry slashed warp yarn, the air temperature within the slasher for heating the warp yarn without the slashing size can range from 275 to 300° F. (135 to 149° C.). It is expected that the finer yarns can most likely be processed at the lower temperatures within these ranges because they should be more easily dried.

In another non-limiting embodiment of the present invention, water can be applied to the resin compatible warp yarns they pass through the slasher in addition to the application of heat. It is believed that the water can improve the reflowing of the resin compatible coating during heating as well as improve the overall appearance of the woven fabric. In one nonlimiting embodiment of the invention, water is applied to the warp yarns prior to heating the warp yarns as discussed above. However, water can also be applied to the warp yarn after heating of the warp yarn has begun. Suitable methods of applying water to the warp yarns include, but are not limited to, dipping the warp yarns in a water bath and spraying. Although not limiting herein, one method of applying water to the warp yarns is to fill the size box 18 of the slasher 10 with water and submerge the warp yarns in the water as they pass through the slasher. In one nonlimiting embodiment of the invention, cold water is applied to the warp yarn. As used herein, "cold water" means water at room temperature (65 to 85° F.) or less. Although not meant to be bound by any particular theory, it is believed that cold water will produce the least amount of wash-off of the primary sizing on the warp yarns as the water is applied. After applying the water, the yarn is heated and dried before being wound onto the loom beam, e.g. using a can-type slasher or a hot air oven and the same temperature ranges as discussed above.

If desired, after applying water to the warp yarns but before passing it through the drier, the warp yarns can be passed between one or more sets of squeeze rolls to remove the excess water prior to heating the warp yarns in a manner similar to that discussed earlier re: removing excess slashing size. Although not limiting herein, in one nonlimiting embodiment of the invention wherein squeeze rolls are employed, the pressure exerted by squeeze rolls ranges from about 10 to about 15 pounds per square inch, plus the dead weight of the roll. Squeeze roll systems are well known to those skilled in the art and further discussion thereof is not deemed necessary in view of the present disclosure.

In the present invention, since no slashing size is applied to the warp yarns as they pass through the slasher, the warp yarns of the warp sheet are essentially free of slashing size. As used herein, the phrase "essentially free of slashing size" means that the warp yarns comprise no greater than 0.5 weight percent slashing size based on a total combined weight of the glass and any coatings positioned thereon, and can comprise no greater than 0.25 weight percent slashing size based on a total combined weight of the glass and any coatings positioned thereon. In one nonlimiting embodiment of the invention, the warp yarns are free of slashing size, i.e. they comprise no slashing size. It should be appreciated that if the operation as described above is used to coat the primary coating of the warp yarn with a secondary coating that is not removed from the yarn, e.g. by a heat cleaning process as discussed above, but rather remains on the yarn and is applied to improved other characteristics of the yarn and/or woven fabric, as used herein, the secondary coating is not a slashing size so that the yarn is still considered to be essentially free of slashing size.

The lack of slashing size on the warp yarns of the loom beams of the present invention is particularly advantageous in both reducing the direct cost of forming the loom beam, due to the elimination of the slashing size itself, and the indirect cost of removing of the slashing size from the warp yarns after weaving, e.g. by heat cleaning and/or scrubbing the fabric. More specifically and as described earlier, since slashing sizes are not resin compatible, they must be removed from the surface of the fibers prior to incorporating the fibers in to a polymeric matrix. By employing a resin compatible coating on the surface of the fibers and eliminating the use of slashing size, the present invention permits the woven fabrics to be directly incorporated into the polymeric matrix without the need for removing the fiber coating(s).

Although the slasher configuration illustrated in FIG. 1 and discussed above dries slashed warp yarn by passing the yarn across multiple sets of drying cans having different temperature profiles, it should be appreciated that the heating of the dry warp yarn or heating and drying of the wetted warp yarn as discussed above can be accomplished using other types of slashers having other drying configurations. For example and without limiting the present invention, all the drying cans of the slasher can be set at the same temperature and/or a single series of drying cans can be used. In another non-limiting configuration and as discussed earlier, the cans can be eliminated and the warp yarn can be dried by passing it through a drying oven that circulates hot air. In yet another non-limiting configuration, a combination of drying cans and circulating hot air can be used.

The present invention further contemplates loom beams made in accordance with the aforementioned methods and fabrics made using such loom beams. More specifically, in one nonlimiting embodiment of the invention, a loom beam comprises a plurality of warp yarns wound around a center roll, wherein at least one of the warp yarns comprises at least one fiber comprising a resin compatible coating on at least a portion of a surface thereof, and the at least one fiber is essentially free of slashing size. In one nonlimiting embodiment of the invention, the plurality of warp yarns each comprise a plurality of glass fibers comprising a resin compatible coating on at least a portion of a surface thereof, and the plurality of glass fibers are essentially free of slashing size. In still another embodiment of the present invention, a loom beam comprises a plurality of warp yarns wound around a center roll, wherein at least one of the warp yarns comprises a resin compatible coating on at least a portion of a surface thereof and is essentially free of slashing size.

A specific non-limiting embodiment of the present invention will now be described in the following example.

EXAMPLE

A loom beam was formed according to the following procedure. Four section beams, each containing approximately 551 ends of G75 warp yarn coated with the resin compatible coating shown as Example F in Table B were positioned on a West Point slasher configured in a manner similar to that shown in FIG. 1. Thereafter, the warp yarns were unwound from the section beams and passed through the slasher. As the warp sheets passed through the slasher, the yarn was submerged in a bath of room temperature water and then passed through a squeeze roll system to remove the excess water. After removing the excess water, the warp yarns were split, with the warp sheet of two of the section beams passing across a first pair of initial drying cans and the warp sheets of the remaining two section beams passing across a second pair of initial drying cans, to initiate the drying operation. The sheets were then recombined and passed across a series of finishing cans to complete the drying. All of the cans were approximately 30 inches (76.2 cm) in diameter and were steam charged, i.e. steam was circulated within the cans to heat them. The initial drying cans were steel cans with a TEFLON® coating and had a surface temperature of 280° F. (138° C.), and the finishing cans were stainless steel and had a surface temperature of 250° F. (121° C.). It should be noted that the TEFLON coating was not added to the cans specifically to process the resin compatible yarn but rather to process starch-oil and slashing sized yarn in a conventional slashing operation. However, it was observed that the TEFLON coating did reduce scorching and sticking of the yarn to the initial drying cans during the initial drying of the yarn. The sheets were then passed through a series of split rods, a hook reed assembly and a comb to separate and position the yarns as they were wound onto the loom beam, as discussed earlier. The yarn passed through the slasher at a rate of 60 yards per minute (54.9 meter per minute) and the yarn was in the drier portion of the slasher for approximately 15 seconds.

Reduction in the number of rolled and twisted ends was noted as the warp yarn sheet left the last finishing can and passed across an idle roller into the split rod/hook reed area. There were no tendencies for the yarn to cling, break, or roll together. 3000 yards (2743 meters) of a 7628 style fabric were woven using a loom beam produced as discussed above with no recorded end breaks during weaving.

The above procedure of using heat and water as described in the Example was also used to form loom beams from G150, E225 and D450 yarn coated with the resin compatible coating shown as Example F in Table 2. However, since the E225 and D450 are fine yarns and are more easily dried, the temperature of the initial drying cans was reduced to 250° F. (121° C.).

A procedure similar to that discussed above in the Example, except that no water was used, was followed to form loom beams from G75 yarn coated with the resin compatible coating shown as Example F in Table 2. 3500 yards (3200 meters) of a 7628 style fabric were woven using a loom beam produced as discussed with no recorded end breaks during weaving. In comparing the 7628 style fabrics woven from the "heat only" warp yarn versus the "heated and watered" warp yarn, it was observed that although both processed and were woven without any problems, the fabric woven from the later yarn had a smoother surface appearance, showed less streaking and had a more consistent overall appearance.

From the foregoing description, it can be seen that the present invention provides a loom beam comprising resin compatible glass fiber warp yarns without a slashing size, as well as a method of forming the loom beam. It will be appreciated by those skilled in the art that changes could be made to the embodiments described above without departing from the broad inventive concept thereof. It is understood, therefore, that this invention is not limited to the particular embodiments disclosed, but it is intended to cover modifications that are within the spirit and scope of the invention, as defined by the appended claims.

We claim:

1. A method of forming a loom beam comprising:

A. unwinding at least one warp yarn from at least one section beam comprising a plurality of warp yarns, wherein the at least one warp yarn comprises at least one fiber comprising a resin compatible coating on at least a portion of a surface thereof;

B. applying heat to the at least one fiber; and

C. winding the at least one warp yarn with the at least one fiber onto a loom beam, wherein the at least one fiber on the loom beam is essentially free of slashing size.

2. The method according to claim 1, wherein applying heat comprises applying an amount of heat sufficient to at least partially reflow at least a portion of the resin compatible coating.

3. The method according to claim 1, wherein applying heat comprises passing at least the at least one fiber over at least one heated roll.

4. The method according to claim 3, wherein applying heat comprises passing at least the at least one fiber over a plurality of heated rolls.

5. The method according to claim 3, wherein the at least one heated roll has a surface temperature of 240° F. to 290° F.

6. The method according to claim 5, wherein the at least one heated roll has a surface temperature of 250° F. to 280° F.

7. The method according to claim 1, wherein applying heat comprises passing at least the at least one fiber through a heating oven containing hot gas.

8. The method according to claim 1, wherein the at least one fiber on the loom beam is free of slashing size.

9. The method according to claim 8, wherein applying heat comprises applying an amount of heat sufficient to at least partially reflow at least a portion of the resin compatible coating.

10. The method according to claim 1, further comprising applying water to the at least one fiber and removing the water prior to winding.

11. The method according to claim 10, wherein the water is applied prior to applying heat, and applying heat comprises applying an amount of heat sufficient to dry the at least one fiber.

12. The method according to claim 11, wherein applying heat further comprises applying an amount of heat sufficient to at least partially reflow at least a portion of the resin compatible coating.

13. The method according to 10, wherein the at least one fiber on the loom beam is free of slashing size.

14. The method according to claim 10, wherein the water is cold water.

15. The method according to claim 10, further comprising removing excess water from the at least one fiber prior to applying heat.

16. The method according to claim 1, wherein the at least one fiber comprises at least one glass fiber comprising a resin compatible coating on at least a portion of a surface thereof.

17. The method according to claim 1, comprising positioning a plurality of section beams, each comprising a plurality of warp yarns, and wherein at least one warp yarn of each section beam comprises at least one glass fiber comprising a resin compatible coating on at least a portion of a surface thereof.

18. A method of forming a loom beam comprising:

A. unwinding at least one warp yarn from at least one section beam comprising a plurality of warp yarns, wherein the at least one warp yarn comprises a resin compatible coating on at least a portion of a surface thereof;

B. applying heat to the at least one warp yarn; and

C. winding the at least one warp yarn onto a loom beam, wherein the at least one warp yarn on the loom beam is essentially free of slashing size.

19. The method according to claim 18, wherein applying heat comprises applying an amount of heat sufficient to at least partially reflow at least a portion of the resin compatible coating.

20. The method according to 18, wherein the at least one warp yarn on the loom beam is free of slashing size.

21. The method according to claim 18, further comprising applying water to the at least one warp yarn and removing the water prior to winding.

22. The method according to claim 21, wherein the water is applied prior to applying heat, and applying heat comprises applying an amount of heat sufficient to dry the at least one warp yarn.

23. The method according to claim 22, wherein applying heat further comprises applying an amount of heat sufficient to at least partially reflow at least a portion of the resin compatible coating.

24. The method according to 22, wherein the at least one warp yarn on the loom beam is free of slashing size.

25. The method according to claim 18, wherein the at least one warp yarn comprises at least one glass fiber comprising a resin compatible coating on at least a portion of a surface thereof.

26. The method according to claim 18, comprising positioning a plurality of section beams, each comprising a plurality of warp yarns, and wherein at least one warp yarn of each section beam comprises at least one glass fiber comprising a resin compatible coating on at least a portion of a surface thereof.

27. A method of forming a loom beam comprising:

A. positioning at least two section beams at a slasher, each section beam comprising a plurality of warp yarns, wherein at least one warp yarn of each section beam comprises at least one glass fiber comprising a resin compatible coating on at least a portion of a surface thereof;

B. passing the at least one warp yarns through the slasher;

C. applying heat to the at least one warp yarns while passing the at least one warp yarns through at a portion of the slasher; and D. combining the plurality of warp yarns from the section beams to form a loom beam, wherein the at least one warp yarns on the loom beam are essentially free of slashing size.

28. The method according to 27, wherein the at least one warp yarns on the loom beam are free of slashing size.

29. The method according to claim 27, further comprising applying water to the at least one warp yarns and removing the water prior to combining.

30. The method according to 29, wherein the at least one warp yarns on the loom beam are free of slashing size.

31. The method according to claim 27, wherein the plurality of warp yarns comprise a plurality of glass fibers comprising a resin compatible coating on at least a portion of a surface thereof, and further comprising passing the plurality of warp yarns through the slasher, applying heat to the plurality of warp yarns while passing the plurality of warp yarns through at least a portion of the slasher, and combining the plurality of warp yarns to form a loom beam, wherein the plurality of warp yarns on the loom beam are essentially free of slashing size.

32. A loom beam comprising:

A. a center roll; and

B. a plurality of warp yarns wound around the center roll, wherein at least one of the warp yarns comprises at least one fiber comprising a resin compatible coating on at least a portion of a surface thereof, and the at least one fiber is essentially free of slashing size.

33. The loom beam according to claim 32, wherein the at least one warp yarn comprises at least one glass fiber comprising a resin compatible coating on at least a portion of a surface thereof.

34. The loom beam according to claim 32, wherein the at least one fiber strand is free of slashing size.

35. The loom beam according to claim 32, wherein the plurality of warp yarns each comprise a plurality of glass fibers comprising a resin compatible coating on at least a portion of a surface thereof, and the plurality of glass fibers are essentially free of slashing size.

36. The loom beam according to claim 35, wherein the plurality of glass fibers are free of slashing size.

37. A loom beam comprising:

A. a center roll; and

B. a plurality of warp yarns wound around the center roll, wherein at least one of the warp yarns comprises a resin compatible coating on at least a portion of a surface thereof and is essentially free of slashing size.

* * * * *